US009179818B2

(12) United States Patent
Boyer et al.

(10) Patent No.: US 9,179,818 B2
(45) Date of Patent: Nov. 10, 2015

(54) SPRAY ARM ASSEMBLY FOR A DISHWASHER APPLIANCE

(75) Inventors: Joel Charles Boyer, Louisville, KY (US); Errin Whitney Gnadinger, Louisville, KY (US); Ronald Scott Tarr, Louisville, KY (US); Satish Kumar Raju Buddharaju, Hyderabad (IN)

(73) Assignee: General Electric Company, Schenectady, NY (US)

( * ) Notice: Subject to any disclaimer, the term of this patent is extended or adjusted under 35 U.S.C. 154(b) by 863 days.

(21) Appl. No.: 13/461,071

(22) Filed: May 1, 2012

(65) Prior Publication Data

US 2013/0291908 A1 Nov. 7, 2013

(51) Int. Cl.
*A47L 15/42* (2006.01)
*A47L 15/23* (2006.01)

(52) U.S. Cl.
CPC ..... *A47L 15/4278* (2013.01); *A47L 15/23* (2013.01)

(58) Field of Classification Search
CPC ..... A47L 15/4278; A47L 15/428; A47L 15/4282; A47L 15/23
See application file for complete search history.

(56) References Cited

U.S. PATENT DOCUMENTS 3,918,644 A * 11/1975 Platt ..... B05B 3/06 239/243
3,941,139 A * 3/1976 Spiegel ..... A47L 15/4282 134/176
2006/0108454 A1 5/2006 Eichholz
2010/0108102 A1 5/2010 Kehl et al.
2013/0074891 A1* 3/2013 Bertsch ..... A47L 15/4282 134/198

* cited by examiner

*Primary Examiner* — Jason Ko
*Assistant Examiner* — Spencer Bell
(74) *Attorney, Agent, or Firm* — Dority & Manning, P.A.

(57) ABSTRACT

A dishwasher appliance is provided with a spray arm assembly. The spray arm assembly defines an orifice for directing liquid out of the spray arm assembly. The orifice can selectively receive a nozzle with a particular outlet geometry. By selectively receiving the nozzle, a spray pattern of liquid exiting the orifice can be changed by replacing or modifying the nozzle without remanufacturing or replacing the spray arm assembly.

17 Claims, 4 Drawing Sheets

FIG. —1—

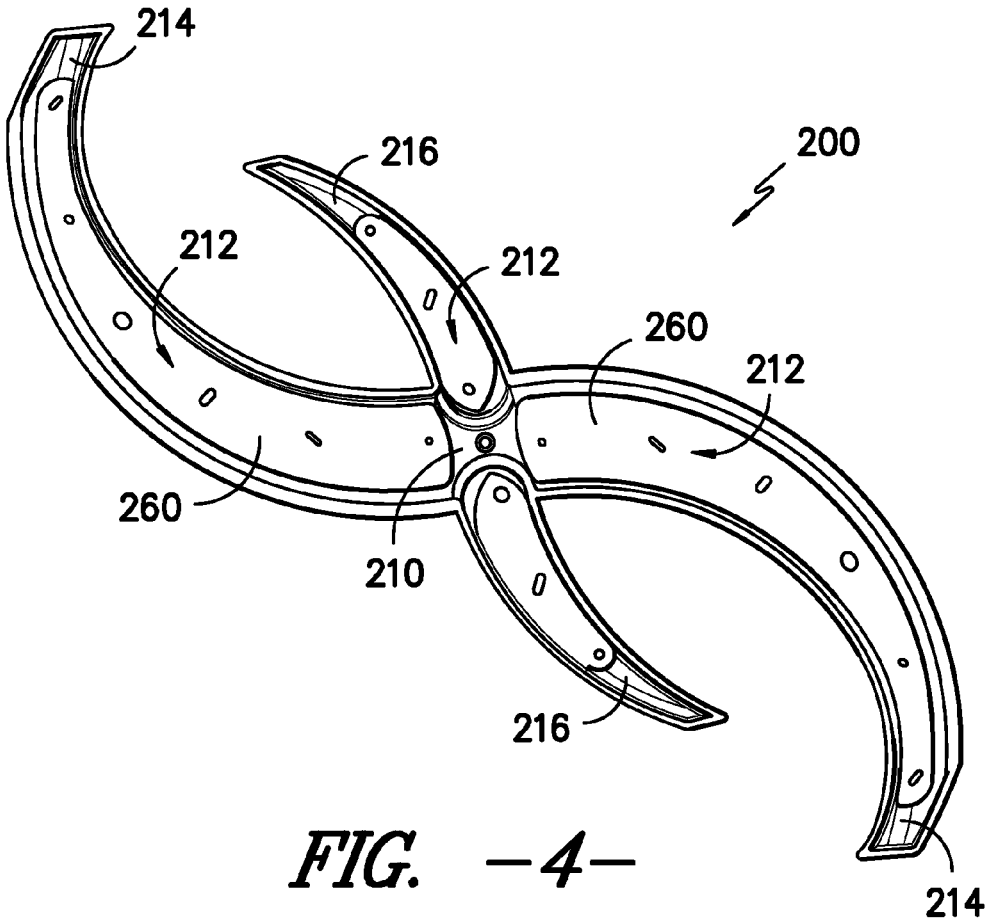
FIG. —4—
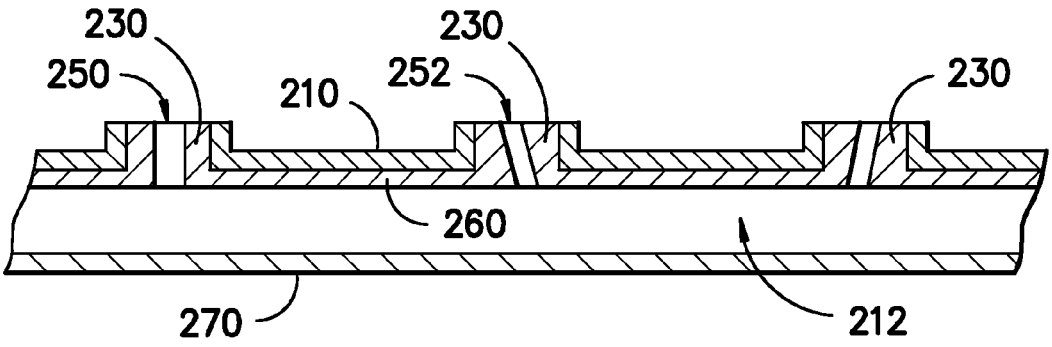
FIG. —5—

SPRAY ARM ASSEMBLY FOR A DISHWASHER APPLIANCE

FIELD OF THE INVENTION

The present subject matter relates generally to spray arms for dishwasher appliances.

BACKGROUND OF THE INVENTION

Dishwasher appliances generally include a tub that defines a wash compartment. A rack assembly can be slidably mounted within the wash compartment and configured for receipt of articles for washing. In addition, dishwasher appliances can include spray arm assemblies for applying wash fluid to articles in the rack assembly.

Spray arm assemblies for dishwasher appliances generally include a housing that defines a cavity. The cavity can receive wash fluid during operation of the dishwasher appliance. The cavity directs such wash fluid to a plurality of orifices defined by the housing. The wash fluid exits the cavity through the orifices and can be directed towards articles within the rack assembly.

Each of the plurality of orifices can have any of a variety of outlet geometries or configurations. For example, a particular one of the plurality of orifices can have a pencil jet geometry or configuration. Conversely, another of the plurality of orifices can have a fan jet geometry or configuration. Various arrangements of outlet geometries can be selected to adjust the spray pattern of the spray arm assembly. For example, pencils jets direct a concentrated stream of wash fluid adapted, e.g., to removing food particles and stains from articles in the rack assembly during a wash cycle. On the other hand, fan jets direct a mist of wash fluid adapted, e.g., to rinsing wash fluid from articles in the rack assembly during a rinse cycle. Accordingly, a dishwasher designer can select outlet geometries in order to generate a particular spray pattern for the spray arm assembly. By carefully selecting the spray pattern, the designer can improve performance of the dishwasher appliance.

In certain dishwasher appliance, the spray arm assembly is molded from single piece of material. Accordingly, during the molding process, the outlet geometries of the plurality of orifices are determined by the mold used to construct the spray arm assembly. Thus, in the event of a design change involving the outlet geometries of the plurality of orifices, the entire mold is modified or replaced. For example, if the designer desires to change the direction of a pencil jet, the entire mold used to construct the spray arm assembly may require replacement or modification.

Replacing or modifying the entire mold can be a time intensive and expensive process. Accordingly, a spray arm assembly with features for more easily modifying an outlet geometry of an orifice would be useful. In particular, a spray arm assembly with features for modifying an outlet geometry of an orifice without requiring modification or remanufacture of the remainder of the spray arm assembly would be useful.

BRIEF DESCRIPTION OF THE INVENTION

A dishwasher appliance is provided with a spray arm assembly. The spray arm assembly defines an orifice for directing liquid out of the spray arm assembly. The orifice can selectively receive a nozzle with a particular outlet geometry. By selectively receiving the nozzle, a spray pattern of liquid exiting the orifice can be changed by replacing or modifying the nozzle without remanufacturing or replacing the spray arm assembly. Aspects and advantages of the invention will be set forth in part in the following description, or may be obvious from the description, or may be learned through practice of the invention.

In a first exemplary embodiment, a spray assembly for a dishwasher appliance is provided. The spray assembly includes a spray arm that defines a chamber configured for receipt of a wash fluid. The spray arm further defines a plurality of orifices. A first nozzle is inserted within one of the plurality of orifices. The first nozzle has a first outlet geometry. A second nozzle is inserted within another one of the plurality of orifices. The second nozzle has a second outlet geometry. The second outlet geometry is different from the first outlet geometry. The first and second nozzles are configured for directing wash fluid out of the chamber of the spray arm.

In a second exemplary embodiment, a dishwasher appliance is provided. The dishwasher appliance has a tub that defines a wash compartment. A rack assembly is received within the wash compartment. The rack assembly is configured for receipt of articles for washing. A spray assembly is configured for applying wash fluid to articles in the rack assembly. The spray assembly includes a spray arm that defines a chamber configured for receipt of a wash fluid. The spray arm further defines a plurality of orifices. A first nozzle is inserted within one of the plurality of orifices. The first nozzle has a first outlet geometry. A second nozzle is inserted within another one of the plurality of orifices. The second nozzle has a second outlet geometry. The second outlet geometry is different from the first outlet geometry. The first and second nozzles are configured for directing wash fluid out of the chamber of the spray arm.

In a third exemplary embodiment, an intermediary component for a spray arm is provided. The intermediary component includes a first nozzle. The first nozzle has a first outlet geometry. A second nozzle has a second outlet geometry. The second outlet geometry is different than the first outlet geometry. A web extends between and connects the first nozzle and the second nozzle.

These and other features, aspects and advantages of the present invention will become better understood with reference to the following description and appended claims. The accompanying drawings, which are incorporated in and constitute a part of this specification, illustrate exemplary embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 4 provides a bottom cross-section view of the spray arm assembly of FIG. 2 taken along line 4-4 of FIG. 2.

FIG. 5 provides a side cross-section view of the spray arm assembly of FIG. 2 taken along line 5-5 of FIG. 2.

DETAILED DESCRIPTION OF THE INVENTION

Figure 1:
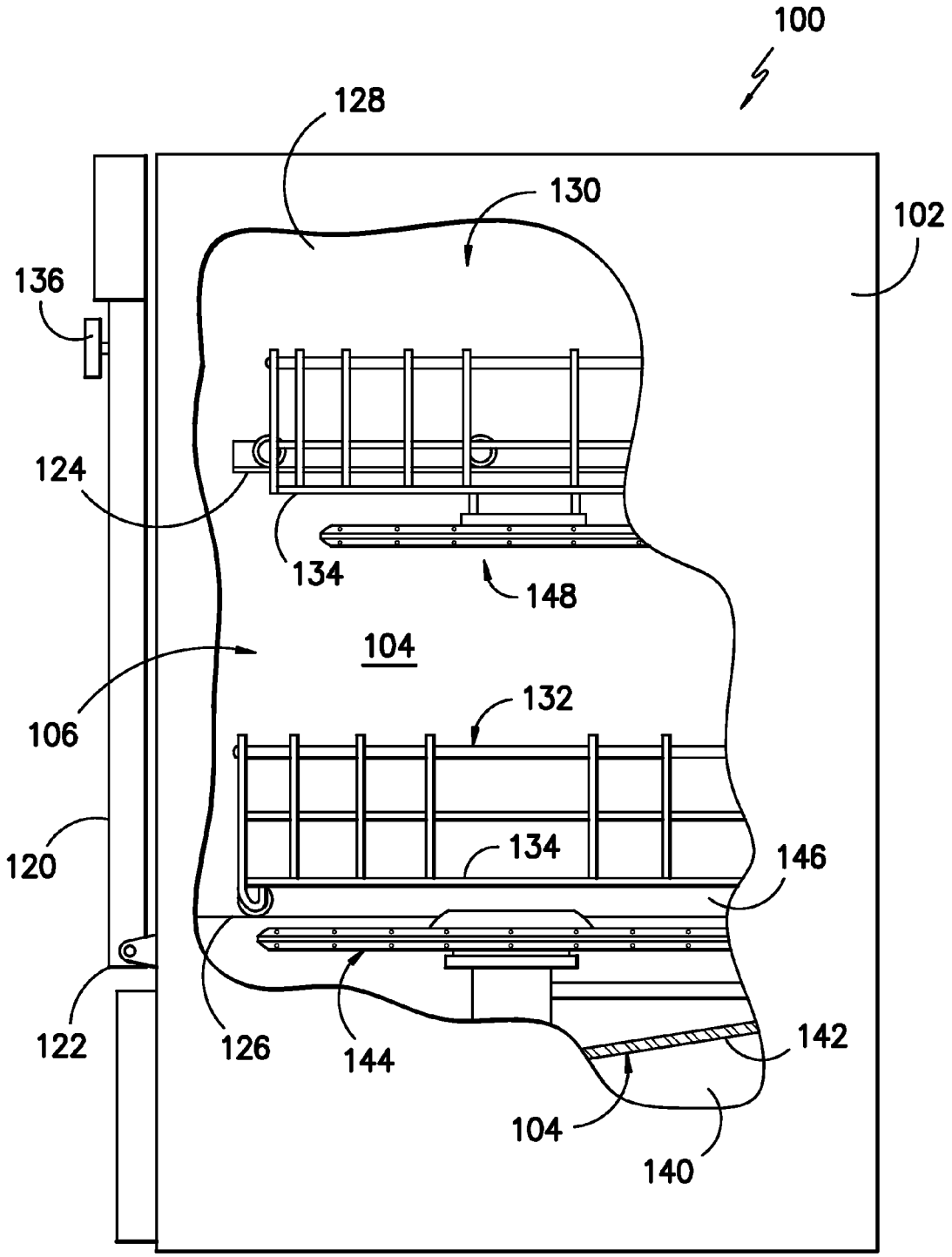
FIG. 1 provides a partial, cross-sectional side view of a dishwasher appliance according to an exemplary embodiment of the present subject matter.

Reference now will be made in detail to exemplary embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a side view of an exemplary domestic dishwasher system 100 shown in partial cut-away and is representative of a type of a dishwasher that may incorporate aspects of the present subject matter. It is contemplated, however, that the present subject matter may be practiced in other types of dishwashers and dishwasher systems beyond dishwasher system 100 described and illustrated herein. Accordingly, the following description is for illustrative purposes only, and the present subject matter is in no way limited to use in a particular type of dishwasher system, such as dishwasher system 100.

Dishwasher 100 includes a cabinet 102 having a tub 104 therein that defines a wash compartment 106. The tub 104 includes a front opening (not shown in FIG. 1) and a door 120 hinged at its bottom 122 for movement between a normally closed vertical position (shown in FIG. 1) wherein the wash compartment 106 is sealed shut for washing operation, and a horizontal open position (not shown) for loading and unloading of dishwasher contents.

Upper and lower guide rails 124, 126 are mounted on tub side walls 128 and accommodate upper and lower roller-equipped racks 130, 132, respectively. Each of upper and lower racks 130, 132 is fabricated from known materials into lattice structures including a plurality of elongate members 134, and each rack 130, 132 is adapted for movement between an extended loading position (not shown) in which the rack is substantially positioned outside the wash compartment 106, and a retracted position (shown in FIG. 1) in which the rack is located inside wash compartment 106. Conventionally, a silverware basket (not shown) is removably attached to the lower rack 132 for placement of silverware, utensils, and the like that are too small to be accommodated by upper and lower racks 130, 132.

A control input selector 136 is mounted at a convenient location on an outer face of the door 120 and is coupled to control circuitry and control mechanisms for operating a fluid circulation assembly (not shown) to circulate water and dishwasher fluid in the dishwasher tub 104. The fluid circulation assembly is located in a machinery compartment 140 located below a bottom sump portion 142 of the tub 104.

A lower spray assembly 144 is mounted within a lower region 146 of the wash compartment 106 and above tub sump portion 142. A mid-level spray assembly 148 is located in an upper region of the wash compartment 106 and is located in close proximity to the upper rack 130 and at a sufficient height above lower rack 132 to accommodate larger items, such as a dish or platter. In a further exemplary embodiment, an upper spray assembly (not shown) may be located above the upper rack 130 at a sufficient height to accommodate taller items, such as a glass of a selected height.

Lower and mid-level spray assemblies 144, 148 and the upper spray assembly are fed by the fluid circulation assembly and include an arrangement of discharge ports or nozzles for directing washing liquid onto dishes located in the upper and lower racks 130, 132, respectively. Lower and mid-level spray assemblies 144, 148 may include spray arms such that the assemblies 144, 148 rotate during application of washing liquid. For example, the arrangement of the discharge ports in the lower and mid-level spray assemblies 144, 148 induces a rotational torque by virtue of the angle and force of the water exiting the discharge ports. The resultant rotation of the lower and mid-level spray assemblies 144, 148 provides coverage of dishes and other articles with a washing spray. Thus, it should be appreciated that one or all of the spray arm assemblies may be rotatably mounted and configured to generate a swirling spray pattern within the wash compartment 106 when the fluid circulation assembly is activated.

Figure 2:
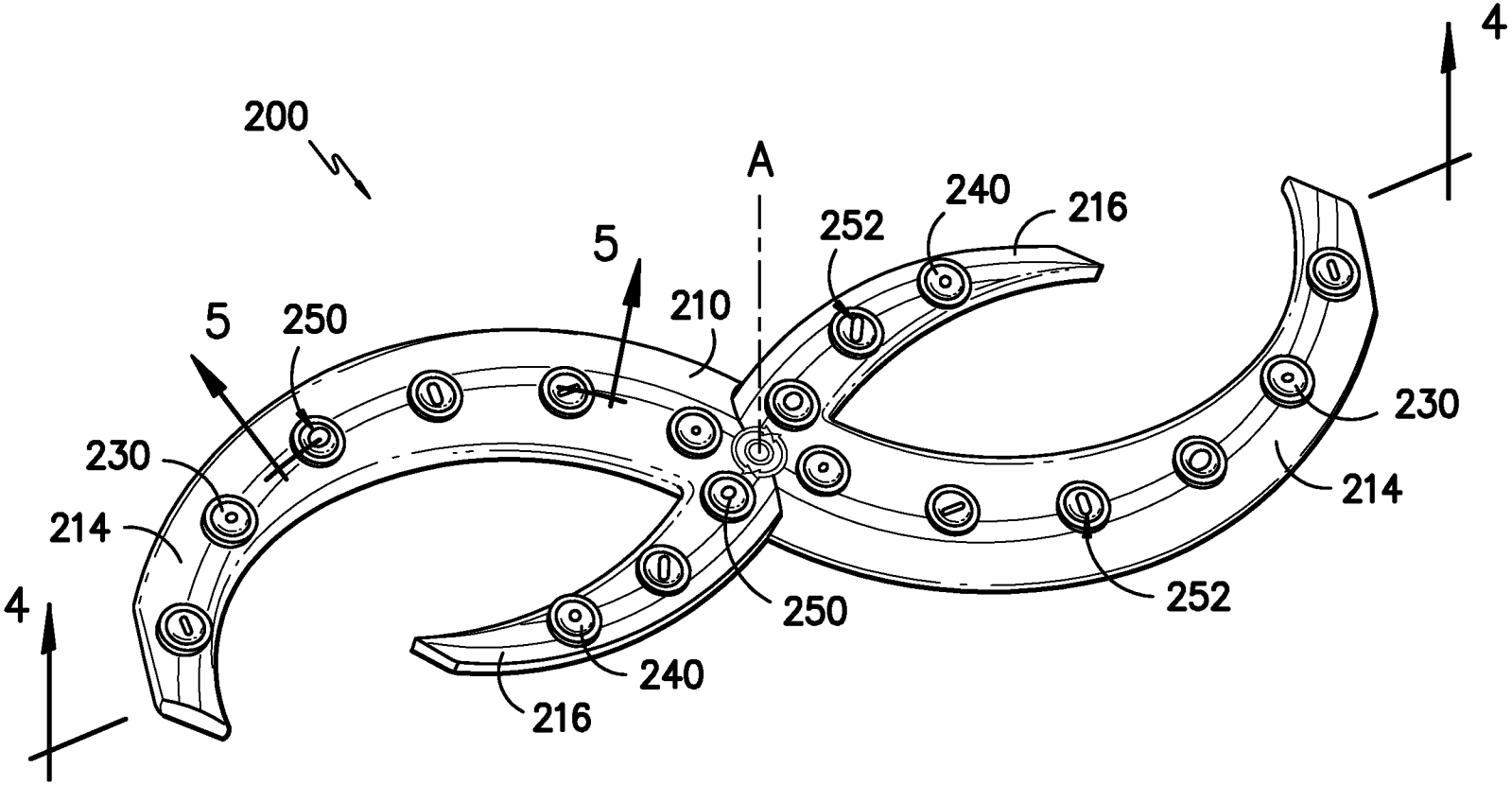
FIG. 2 illustrates a top, perspective view of an exemplary embodiment of a spray arm assembly as may be used in the dishwasher appliance of FIG. 1 and, in particular, illustrates a first plurality of exemplary nozzles and a second plurality of exemplary nozzles of the spray arm assembly.

FIG. 2 illustrates a perspective view of an exemplary embodiment of a spray arm assembly 200 that, e.g., may be used in dishwasher appliance 100 as lower, and/or mid-level spray assemblies 144, 148. Spray arm assembly 200 includes an upper housing 210. Upper housing 210 is configured for directing washing fluid during operation of dishwasher appliance 100 (FIG. 1) as described in greater detail below. Upper housing 210 may be constructed of metal, plastic, and/or any suitable material or combination of materials.

Upper housing 210 includes a first pair of arms 214 and a second pair of arms 216. First and second pair of arms 214, 216 are configured for rotation about an axis of rotation A, e.g., during operation of dishwasher appliance 100. In FIG. 2, first and second pairs of arms 214, 216 extend away from axis of rotation A arcuately. However, it should be understood that spray arm assembly 200 is provided an example only and is not intended to be limiting. Thus, spray arm assembly 200 may have any suitable configuration. For example, first and second pairs of arms 214, 216 may be substantially linear or have any other suitable shape. Similarly, spray arm assembly 200 may include only first or second pairs of arms 214, 216 or may contain any suitable number of additional arms.

Upper housing 210 supports a first plurality of inserts or nozzles 230 on first pair of arms 214 and a second plurality of inserts or nozzles 240 on second pair of arms 216. First and second pluralities of nozzles 230, 240 direct liquid from within spray arm assembly 200 out of spray arm assembly 200 as discussed in greater detail below. First and second pluralities of nozzles 230, 240 define various exit or outlet geometries. For example, first and second pluralities of nozzles 230, 240 include nozzles with various pencil jet outlet geometries 250 and other nozzles with various fan jet outlet geometries 252.

Pencil jet geometries 250 direct a substantially columnar jet of liquid out of upper housing 210. Pencil jet geometries 250 may have varying circumferences in order to direct jets of liquid with various circumferences out of upper housing 210. Also, pencil jet geometries 250 may be directed in various directions to provide particular spray patterns. Nozzles 230, 240 with pencil jet geometries 250 may, e.g., be suitable for removing or urging food particles off of articles within dishwasher appliance 100 (FIG. 1). Conversely, fan jet geometries 252, e.g., direct a substantially conic or triangular jet of liquid out of upper housing 210. Nozzles 230, 240 with fan jet geometries 252 may, e.g., be suitable for rinsing or soaking articles within dishwasher appliance 100.

Thus, for example, first and second pluralities of nozzles 230 and 240 may include a first pencil jet geometry 250 with a first diameter and a second pencil jet geometry 250 with a second diameter. As another example, first and second pluralities of nozzles 230 and 240 may include a first pencil jet geometry 250 that directs wash fluid in a first direction and a second pencil jet geometry 250 that directs wash fluid in a second direction. As a further example, first and second pluralities of nozzles 230 and 240 may include a pencil jet geometry 250 and a fan jet geometry 252. However, it should be understood that first and second pluralities of nozzles 230, 240 may have any other suitable outlet geometry or combination of geometries. Thus, the examples of outlet geometries disclosed herein are not intended to be limiting.

First and second pluralities of nozzles 230, 240 may be constructed of any suitable material. For example, first and second pluralities of nozzles 230, 240 may be constructed of a plastic. In addition, first and second pluralities of nozzles 230, 240 may be constructed of a substantially rigid material, e.g., polyethylene, polypropylene, polystyrene, polyvinyl chloride, or any other suitable substantially rigid plastic or material. Alternatively, first and second pluralities of nozzles 230, 240 may be constructed of a substantially elastic material, e.g., an elastomer or any other suitable substantially elastic material.

Figure 3:
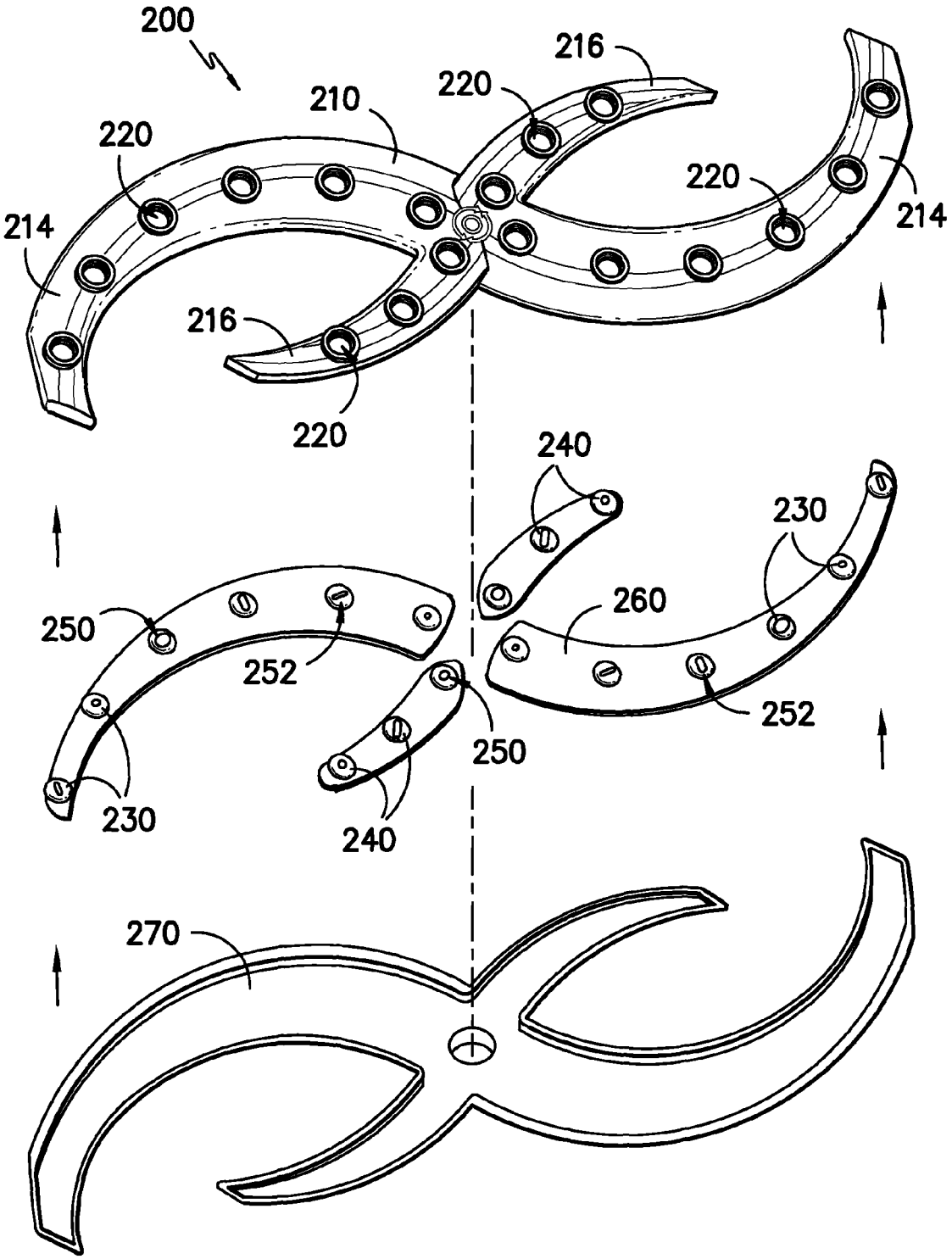
FIG. 3 illustrates an exploded, perspective view of the spray arm assembly of FIG. 2.

FIG. 3 illustrates an exploded view of spray arm assembly 200. As may be seen in FIG. 3, upper housing 210 defines a plurality of orifices 220. Orifices 220 receive first and second pluralities of nozzles 230, 240 as may be seen in FIG. 2. Thus, first and second pluralities of nozzles 230, 240 are inserted into orifices 220. Orifices 220 are substantially uniformly distributed on first and second pairs of arms 214, 216. However, orifices 220 may be distributed in any suitable manner, e.g., non-uniformly.

In FIG. 3, first and second pluralities of nozzles 230, 240 both include a web or sheet 260 that connects the various nozzles of first and second pluralities of nozzles 230, 240. Thus, for example, sheet 260 extends between the nozzles of first plurality of nozzles 230 and couples or secures the nozzles together. However, it should be understood that in alternative exemplary embodiments, first and second pluralities of nozzles 230, 240 need not include sheets 260. For example, each nozzle of first and second pluralities of nozzles 230, 240 may be independently inserted into a particular one of the orifices 220. Thus, the nozzles of first and second pluralities of nozzles 230, 240 need not be coupled or secured together. As may be seen in FIG. 4, sheet 260 is disposed within upper housing 210, e.g., within a chamber 212 (FIG. 5), when spray arm assembly 200 is assembled.

First and second pluralities of nozzles 230, 240 may be secured to upper housing 210 and within orifices 220 in a variety of ways. For example, first and second pluralities of nozzles 230, 240 may be secured within orifices 220, e.g., using heat staking, ultrasonic welding, co-molding, overmolding, and/or any other suitable method or combination of methods. Such methods may be used when first and second pluralities of nozzles 230, 240 are substantially rigid.

Conversely, first and second pluralities of nozzles 230, 240 may simply be inserted into orifices 220 and mechanically secured therein. For example, a complementary snap-fit or interference fit may be used to secure first and second pluralities of nozzles 230, 240 within orifices 220. By way of additional example, the first and second pluralities of nozzles 230, 240 can deform during insertion through orifices 220. After insertion and when first and second pluralities of nozzles 230, 240 are properly positioned within orifices as shown in FIG. 2, first and second pluralities of nozzles 230, 240 may be held in place by portions of first and second pluralities of nozzles 230, 240 with a diameter greater than a diameter of orifices 220. Such methods may be used, for example, when first and second pluralities of nozzles 230, 240 are substantially elastic.

A bottom housing 270 is shaped to fit upper housing 210. Thus, bottom housing 270 mounts to upper housing 210 in order to form spray arm assembly 200. Bottom housing 270 cooperates with upper housing 210 to direct wash fluid during operation of dishwasher appliance 100 as described in greater detail below. In FIG. 3, bottom housing 270 does not define additional orifices 220. However, in alternative exemplary embodiments, bottom housing 270 may define additional orifices that receive nozzles and direct wash fluid into wash chamber 106. Bottom housing 270 may be constructed of metal, plastic, and/or any suitable material or combination of materials.

FIG. 4 provides a bottom cross-section view of spray arm assembly 200 taken along the line 4-4 of FIG. 2. FIG. 5 provides a side cross-section view of spray arm assembly 200 taken along the line 5-5 of FIG. 2. As shown in FIG. 5, upper housing 210 and bottom housing 270 define a chamber 212 for receipt of wash fluid (e.g., water and/or detergent) during operation of dishwasher appliance 100 (FIG. 1). Chamber 212 is in fluid communication with the fluid circulation assembly (not shown) described above.

First and second pluralities of nozzles 230, 240 are disposed within orifices 220 (FIG. 3). Thus, during operation of dishwasher appliance 100, wash fluid flows through chamber 212 of spray arm assembly 200 and exits chamber 212 through first and second pluralities of nozzles 230, 240. As may be seen in FIG. 5, wash fluid may be directed in various directions by nozzles 230.

It should be understood that, by providing first and second pluralities of nozzles 230, 240 that are received within orifices 220, a spray pattern for liquid emitted from spray arm assembly 200 may be modified or customized. For example, nozzles with various outlet geometries may be inserted into any particular one of the orifices 220. Thus, as will be understood by those skilled in the art, nozzles may be selected to customize and/or improve the spray pattern of spray arm assembly 200, e.g., while still using a single model of upper housing 210 and/or bottom housing 270.

In various exemplary embodiments, first plurality of nozzles 230 may be a first color (e.g., blue). Conversely, second plurality of nozzles 240 may be a second color (e.g., green). Thus, the first and second pluralities of nozzles 230, 240 may be different colors. In particular, first and second pluralities of nozzles 230, 240 may contain dyes or pigments for providing the first and second colors respectively.

Upper housing 210 may be a third color (e.g., red). Thus, upper housing 210 and first and second pluralities of nozzles 230, 240 may each be a different color. However, it should be understood that upper housing 210 and first and second pluralities of nozzles 230, 240 may be the same color or have any suitable combination of colors. Varying colors between upper housing 210 and first and second pluralities of nozzles 230, 240 may, e.g., permit product differentiation or provide marketing advantages as well as provide ready identification of parts during assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A spray assembly for a dishwasher appliance comprising:

a spray arm defining a chamber configured for receipt of a wash fluid, said spray arm further defining a plurality of orifices;

a first nozzle inserted within one of the plurality of orifices, the first nozzle 5 having a first outlet geometry;

a second nozzle inserted within another one of the plurality of orifices, the second nozzle having a second outlet geometry, the second outlet geometry being different from the first outlet geometry, wherein said first and second nozzles are configured for directing wash fluid out of the chamber of said spray arm; and a sheet extending between said first nozzle and said second nozzle, said first nozzle and said second nozzle mounted to said sheet, said sheet disposed within the chamber of said spray arm.

2. The spray assembly of claim 1, wherein said first nozzle is a first color and said spray arm is a second color, wherein the first color is different from the second color.

3. The spray assembly of claim 2, wherein said second nozzle is a third color, wherein third color is different from the first and second colors.

4. The spray assembly of claim 1, wherein the first outlet geometry comprises a pencil jet geometry and the second outlet geometry comprises a fan jet geometry.

5. The spray assembly of claim 1, wherein the first outlet geometry comprises a pencil jet geometry with a first diameter and the second outlet geometry comprises a pencil jet geometry with a second diameter, wherein the first diameter is different than the second diameter.

6. The spray assembly of claim 1, wherein the first outlet geometry comprises a pencil jet geometry that directs wash fluid in a first direction and the second outlet geometry comprises a pencil jet geometry that directs wash fluid in a second direction, wherein the first direction is different than the second direction.

7. The spray assembly of claim 6, wherein said first nozzle or said second nozzle is heat staked, ultrasonically welded, over-molded, or co-molded to said spray arm.

8. The spray assembly of claim 1, wherein said first and second nozzles are constructed of a rigid material.

9. The spray assembly of claim 1, wherein said first and second nozzles are constructed of an elastic material.

10. A dishwasher appliance having a tub that defines a wash compartment, a rack assembly is received within the wash compartment, the rack assembly is configured for receipt of articles for washing, a spray assembly is configured for applying wash fluid to articles in the rack assembly, the spray assembly comprising:

a spray arm defining a chamber configured for receipt of the wash fluid, said spray arm further defining a plurality of orifices;

a first nozzle inserted within one of the plurality of orifices, the first nozzle having a first outlet geometry;

a second nozzle inserted within another one of the plurality of orifices, the second nozzle having a second outlet geometry, the second outlet geometry being different from the first outlet geometry, wherein the first and second outlet geometries are configured for directing wash fluid out of the chamber of said spray arm towards articles in the rack assembly; and a sheet extending between said first nozzle and said second nozzle, said first nozzle and said second nozzle mounted to said sheet, said sheet disposed within the chamber of said spray arm.

11. The dishwasher appliance of claim 10, wherein said first nozzle is a first color and said spray arm is a second color, wherein the first color is different from the second color.

12. The dishwasher appliance of claim 11, wherein said second nozzle is a third color, wherein third color is different from the first and second colors.

13. The dishwasher appliance of claim 10, wherein the first outlet geometry comprises a pencil jet geometry and the second outlet geometry comprises a fan jet geometry.

14. The dishwasher appliance of claim 10, wherein the first outlet geometry comprises a pencil jet geometry with a first diameter and the second outlet geometry comprises a pencil jet geometry with a second diameter, wherein the first diameter is different than the second diameter.

15. The dishwasher appliance of claim 10, wherein the first outlet geometry comprises a pencil jet geometry that directs wash fluid in a first direction and the second outlet geometry comprises a pencil jet geometry that directs wash fluid in a second direction, wherein the first direction is different than the second direction.

16. The dishwasher appliance of claim 15, wherein said first nozzle and second nozzle are heat staked, ultrasonically welded, over-molded, or co-molded to said spray arm.

17. The dishwasher appliance of claim 10, wherein said first and second nozzles are constructed of a rigid material.

* * * * *